US008622152B2

(12) United States Patent
Lyon et al.

(10) Patent No.: US 8,622,152 B2
(45) Date of Patent: Jan. 7, 2014

(54) DOWN-THE-HOLE DRILL HAMMER HAVING A SLIDING EXHAUST CHECK VALVE

(75) Inventors: Leland H. Lyon, Roanoke, VA (US); Warren Thomas Lay, Catawba, VA (US)

(73) Assignee: Center Rock Inc., Berlin, PA (US)

( * ) Notice: Subject to any disclaimer, the term of this patent is extended or adjusted under 35 U.S.C. 154(b) by 452 days.

(21) Appl. No.: 12/909,495

(22) Filed: Oct. 21, 2010

(65) Prior Publication Data

US 2012/0006598 A1 Jan. 12, 2012

Related U.S. Application Data

(63) Continuation-in-part of application No. 12/361,263, filed on Jan. 28, 2009, now Pat. No. 8,302,707.

(51) Int. Cl.
*E21B 4/14* (2006.01)

(52) U.S. Cl.
USPC ..... 175/296; 175/17; 175/78; 175/135

(58) Field of Classification Search
USPC ..... 175/17, 78, 135, 15, 296, 293; 173/91, 173/17, 78
See application file for complete search history.

(56) References Cited

U.S. PATENT DOCUMENTS

| | | | | |
|---|---|---|---|---|
| 1,815,660 A | | 7/1931 | Walker | |
| 2,038,602 A | | 4/1936 | Redinger | |
| 2,379,472 A | | 7/1945 | Bowman | |
| 2,710,740 A | | 6/1955 | Dempsey | |
| 3,893,521 A | | 7/1975 | Bailey et al. | |
| 3,991,834 A | | 11/1976 | Curington | |
| 4,050,525 A | * | 9/1977 | Kita | 173/17 |
| 4,085,809 A | | 4/1978 | Lovell et al. | |
| 4,333,537 A | | 6/1982 | Harris et al. | |
| 4,530,408 A | * | 7/1985 | Toutant | 173/17 |
| 4,691,779 A | | 9/1987 | McMahan et al. | |
| 4,765,418 A | | 8/1988 | Ennis | |
| 4,819,739 A | | 4/1989 | Fuller | |

(Continued)

FOREIGN PATENT DOCUMENTS

| | | |
|---|---|---|
| EP | 1910640 B1 | 4/2008 |
| KR | 10-2006-0106388 | 10/2006 |

(Continued)

OTHER PUBLICATIONS

Office Action issued May 17, 2011 in U.S. Appl. No. 12/361,263.

(Continued)

*Primary Examiner* — Kenneth L Thompson
*Assistant Examiner* — James Sayre
(74) *Attorney, Agent, or Firm* — Kim Winston LLP

(57) ABSTRACT

A down-the-hole drill hammer having a housing, a backhead and a tubular sliding check valve assembly that includes a distal end, a threaded male proximal end, a supply inlet and an exhaust port. The exhaust port communicates between an interior of the backhead and an exterior of the backhead. The tubular sliding check valve assembly includes a distributor, a sliding valve, and a biasing member. The distributor has a central opening extending through the distributor, an aperture extending through the distributor, and an exhaust gallery. The sliding valve is slidable along the central opening. The biasing member biases the sliding valve to a closed position.

25 Claims, 13 Drawing Sheets

(56) References Cited

U.S. PATENT DOCUMENTS

| | | | | |
|---|---|---|---|---|
| 4,878,550 | A | 11/1989 | Chuang | |
| 4,919,221 | A | 4/1990 | Pascale | |
| 5,065,827 | A | 11/1991 | Meyers et al. | |
| 5,085,284 | A | 2/1992 | Fu | |
| 5,301,761 | A | 4/1994 | Fu et al. | |
| 5,305,837 | A | 4/1994 | Johns et al. | |
| 5,322,136 | A | 6/1994 | Bui et al. | |
| 5,322,139 | A | 6/1994 | Rose et al. | |
| 5,398,772 | A | 3/1995 | Edlund | |
| 5,794,516 | A | 8/1998 | Wolfer et al. | |
| 5,915,483 | A | 6/1999 | Gien | |
| 5,984,021 | A | 11/1999 | Pascale | |
| RE36,848 | E | 9/2000 | Bui et al. | |
| 6,125,952 | A | 10/2000 | Beccu et al. | |
| 6,131,672 | A | 10/2000 | Beccu et al. | |
| 6,135,216 | A | 10/2000 | Lyon et al. | |
| 6,170,581 | B1 | 1/2001 | Lay | |
| 6,237,704 | B1 | 5/2001 | Lay | |
| 6,263,969 | B1 | 7/2001 | Stoesz et al. | |
| D454,143 | S | 3/2002 | Åsberg | |
| 6,502,650 | B1 | 1/2003 | Beccu | |
| 6,637,520 | B1 | 10/2003 | Purcell | |
| 6,698,537 | B2 | 3/2004 | Pascale et al. | |
| 6,708,784 | B1 | 3/2004 | Borg | |
| 7,017,682 | B2 | 3/2006 | Chan et al. | |
| 7,117,939 | B1 | 10/2006 | Hawley et al. | |
| 7,159,676 | B2 | 1/2007 | Lyon | |
| 7,163,058 | B2 | 1/2007 | Bakke et al. | |
| 7,198,120 | B2 | 4/2007 | Gien | |
| 7,389,833 | B2 | 6/2008 | Walker et al. | |
| 7,467,675 | B2 | 12/2008 | Lay | |
| 7,617,889 | B2 | 11/2009 | Beccu | |
| 8,312,944 | B2 * | 11/2012 | Marshall et al. | 175/414 |
| 2003/0102167 | A1 | 6/2003 | Pascale et al. | |
| 2004/0188146 | A1 | 9/2004 | Egerstrom | |
| 2006/0225885 | A1 | 10/2006 | Mcgarian et al. | |
| 2006/0249309 | A1 | 11/2006 | Cruz | |
| 2007/0039761 | A1 | 2/2007 | Cruz | |
| 2008/0087473 | A1 | 4/2008 | Hall et al. | |
| 2008/0156539 | A1 | 7/2008 | Ziegenfuss | |
| 2010/0059284 | A1 | 3/2010 | Lyon et al. | |
| 2010/0089649 | A1 | 4/2010 | Welch et al. | |
| 2010/0243333 | A1 | 9/2010 | Purcell | |
| 2010/0252330 | A1 | 10/2010 | Gilbert et al. | |
| 2011/0303464 | A1 * | 12/2011 | Mulligan | 175/296 |

FOREIGN PATENT DOCUMENTS

| | | | |
|---|---|---|---|
| WO | 2007010513 | A1 | 1/2007 |
| WO | 2007077547 | A1 | 7/2007 |
| WO | 2009124051 | A2 | 10/2009 |
| WO | 2010082889 | | 7/2010 |

OTHER PUBLICATIONS

Int'l Search Report issued May 31, 2011 in Int'l Application No. PCT/US2010/056917; Written Opinion.
Office Action issued Nov. 29, 2012 in U.S. Appl. No. 12/621,155.
Office Action issued Nov. 8, 2012 in Canadian Application No. 2,750,810.
Examination Report issued Dec. 7, 2012 in Australian Application No. 2010208528.
Office Action issued Jan. 19, 2012 in U.S. Appl. No. 12/361,263.
Office Action issued Feb. 1, 2012 in AU Application No. 2009231791.
Office Action issued May 10, 2012 in U.S. Appl. No. 12/361,263.
Office Action issued Jun. 7, 2012 in U.S. Appl. No. 12/621,155.
Office Action issued Jun. 4, 2012 in Canadian App. No. 2,718,669.
Office Action issued May 14, 2012 in Swedish App. No. 1150769-6.
Office Action issued Jun. 21, 2012 in Swedish App. No. 1150985-8.
Office Action Issued Dec. 7, 2010 in U.S. Appl. No. 12/361,263.
Office Action issued Dec. 23, 2011 in U.S. Appl. No. 12/621,155.
Office Action issued Feb. 7, 2012 in Chilean Patent Application No. 1015/2010.
International Preliminary Report on Patentability issued Mar. 13, 2012 in International Application No. PCT/US2010/021011.
Office Action issued Sep. 15, 2011 in AU Application No. 2009231791.
Int'l Search Report and Written Opinion issued on May 26, 2009 in Int'l Application No. PCT/US2009/038957.
Int'l Search Report and Written Opinion Issued Mar. 19, 2010 in Int'l Application No. PCT/US2010/021011.
Office Action Issued Jun. 24, 2010 in U.S. Appl. No. 12/361,263.
Int'l Preliminary Report on Patentability issued on Oct. 5, 2010 in Int'l Application No. PCT/US2009/038957.
Written Opinion Issued Feb. 22, 2011 in Int'l Application No. PCT/US2010/021011, 4 pages.
Office Action Issued Apr. 11, 2011 in U.S. Appl. No. 12/621,155.
Office Action issued Jun. 30, 2011 in SE Application No. 1051069-1.
Office Action issued Oct. 18, 2011 in U.S. Appl. No. 12/621,155.
Office Action issued Mar. 22, 2013 in Swedish Application No. 1250524-4.
Office Action issued Apr. 17, 2013 in Swedish Application No. 1051069-1.
Office Action issued Apr. 15, 2013 in Korean Application No. 10-2011-7019644.
Office Action issued May 14, 2013 in U.S. Appl. No. 12/933,041.
Office Action issued May 28, 2013 in U.S. Appl. No. 12/621,155.
Office Action issued May 9, 2013 in Canadian Application No. 2,755,592.
Office Action issued May 10, 2013 in Canadian Application No. 2,750,810.
Office Action issued May 31, 2013 in Australian Application No. 2011235927.
Office Action issued May 7, 2013 in Chilean Application No. 1785-2011.

* cited by examiner

DOWN-THE-HOLE DRILL HAMMER HAVING A SLIDING EXHAUST CHECK VALVE

CROSS REFERENCE TO RELATED APPLICATIONS

The present application is a continuation-in-part of pending U.S. patent application Ser. No. 12/361,263, filed Jan. 28, 2009, entitled "Down-the-Hole Drill Reverse Exhaust System," the entire disclosure of which is hereby incorporated herein by reference.

BACKGROUND OF THE INVENTION

The present invention relates to a down-the-hole drill ("DHD") hammer. In particular, the present invention relates to a DHD hammer having a sliding exhaust check valve assembly and more particularly, a sliding exhaust check valve assembly that combines supply and exhaust check valves into a single unit operation.

Typical DHD hammers utilize what is known as "reactive" seals for sealing the DHD hammer's interior from its exterior environment, such as water and debris. The seals are known as "reactive" seals because they require the movement of exhaust flow to displace or open flow passageways within the DHD hammer. However, such DHD hammers also require that exhaust pressures be minimized for proper functioning of the DHD hammer. As such, the level of reactive forces/pressures for the "reactive" seals were also minimized, thereby potentially negatively impacting the "reactive" seal's effectiveness.

A DHD hammer, such as the present invention, having a sliding exhaust check valve addresses the foregoing limitations of reactive seals.

BRIEF SUMMARY OF THE INVENTION

In a preferred embodiment, the present invention provides a down-the-hole drill hammer comprising a housing, a backhead and a tubular sliding check valve assembly. The backhead is positioned at a proximal end of the housing and includes a distal end, a threaded male proximal end, a supply inlet and an exhaust port. The supply inlet receives a supply of working fluid to an interior of the backhead. The exhaust port provides for communication between the interior of the backhead and an exterior of the backhead. The tubular sliding check valve assembly is within the housing proximate to the backhead. The sliding check valve assembly includes a distributor, a sliding valve, and a biasing member. The distributor has a central opening, an aperture extending through the distributor and offset from the central opening for allowing the passage of working fluid through the distributor, and an exhaust gallery for communicating between the central opening and the exhaust port. The sliding valve is slidable along the central opening and movable between a closed position and an open position. The sliding valve has a closed proximal end, an open distal end, and an opening about a midsection of the sliding valve. In the closed position, a proximal end of the sliding valve sealingly engages the supply inlet and a distal end of the sliding valve sealingly engages an inlet opening of the exhaust gallery. In the open position, the sliding valve is offset from the supply inlet, the openings of the sliding valve are in communication with the exhaust gallery, and the supply inlet is in communication with the aperture extending through the distributor. The biasing member biases the sliding valve.

In accordance with another preferred embodiment, the present invention provides a down-the-hole drill hammer comprising a housing, a backhead, and a tubular sliding check valve assembly. The backhead is positioned at a proximal end of the housing and includes a distal end, a threaded male proximal end, a supply inlet for receiving a supply of working fluid to an interior of the backhead, an exhaust port for communicating between the interior of the backhead and an exterior of the backhead, a tubular distal end, and a tapered mid-section interior in communication with the supply inlet. The tapered mid section interior includes a frustroconical section adjacent the supply inlet, and a tubular section adjacent the frustroconical section. The tubular sliding check valve assembly is housed within the housing proximate to the backhead. The sliding check valve assembly includes a distributor, a sliding valve, and a biasing member. The distributor has a central opening, an aperture extending through the distributor in an axial direction and offset from the central opening for allowing the passage of working fluid through the distributor, and an exhaust gallery for communicating between the central opening and the exhaust port. The sliding valve is slidable along the central opening and movable between a closed position and an open position. The sliding valve includes a closed proximal end, an open distal end, and an opening about a midsection of the sliding valve. The biasing member biasing the sliding valve to the closed position. In the closed position, a proximal end of the sliding valve sealingly engages the supply inlet and a distal end of the sliding valve sealingly engages an inlet opening of the exhaust gallery. In the open position, the sliding valve is offset from the supply inlet, the openings of the sliding valve are in communication with the exhaust gallery, and the supply inlet is in communication with the aperture extending through the distributor.

In accordance with yet another preferred embodiment, the present invention provides a down-the-hole drill hammer that includes a housing, a backhead, a tubular sliding check valve assembly, a biasing member, a solid-core piston and a seal. The backhead is located at a proximal end of the housing and includes a supply inlet for receiving a supply of working fluid to an interior of the backhead. The tubular sliding check valve assembly is housed within the housing and located proximate the backhead. The sliding check valve assembly includes a distributor and a sliding valve slidable along the distributor. The sliding valve has a closed proximal end, an open distal end, an opening about a midsection of the sliding valve, and an inwardly extending flange, wherein the inwardly extending flange has a distally facing surface area. The biasing member biases the sliding valve to sealingly engage the closed proximal end to the supply inlet. The seal is located proximate a distal end of the housing between the solid-core piston and the housing.

In accordance with another preferred embodiment, the present invention provides a down-the-hole drill hammer that includes a housing, a backhead, a tubular sliding check valve assembly, a biasing member, a solid-core piston, a seal and a drive chamber. The backhead is located at a proximal end of the housing and includes a supply inlet for receiving a flow of supply pressure to an interior of the backhead. The tubular sliding check valve assembly is housed within the housing and located proximate the backhead. The sliding check valve assembly includes a distributor and a sliding valve slidable along the distributor. The sliding valve has a closed proximal end, an open distal end, and an opening about a midsection of the sliding valve. The biasing member biases the sliding valve to sealingly engage the closed proximal end to the supply inlet. The seal is located proximate a distal end of the housing between the solid-core piston and the housing. The driver chamber is positioned between the backhead and the solid-core piston. The closed proximal end of the sliding valve sealingly engages the supply inlet while the solid-core piston sealingly engages the seal proximate the distal end of the housing when a flow of supply pressure entering the down-the-hole drill hammer is discontinued to maintain an elevated pressure within the drive chamber.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown.

In the drawings.

DETAILED DESCRIPTION OF THE INVENTION

Figure 1:
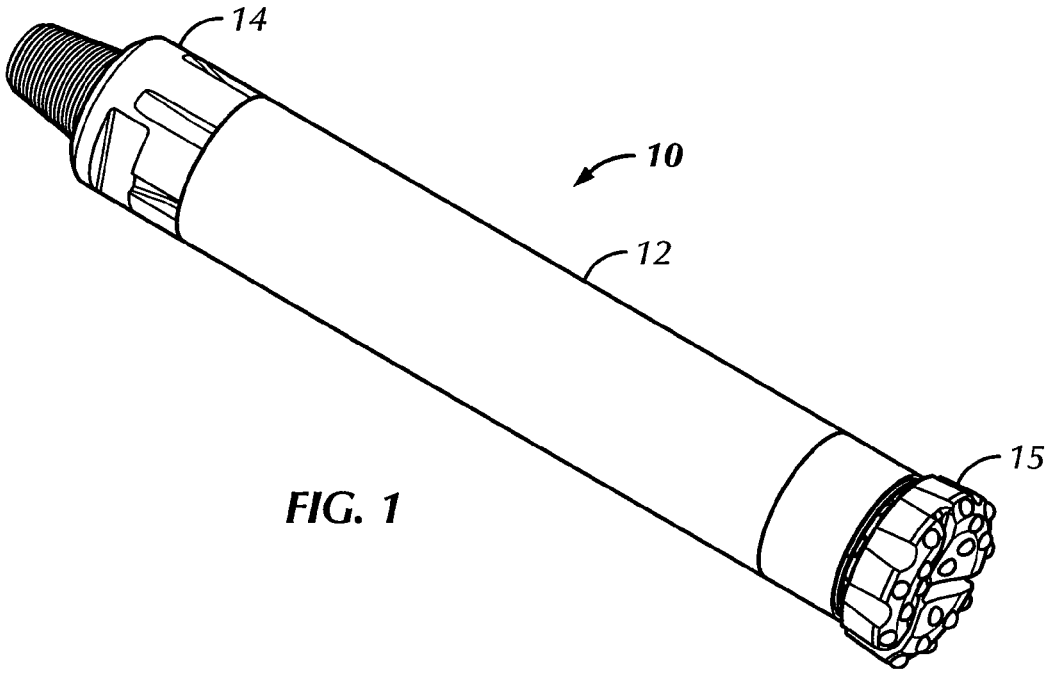
FIG. 1 is a perspective view of a DHD hammer in accordance with a preferred embodiment of the present invention.

Certain terminology is used in the following description for convenience only and is not limiting. The words "right," "left," "upper," and "lower" designate directions in the drawings to which reference is made. For purposes of convenience, "distal" is generally referred to as toward the drill bit end of the DHD hammer, and "proximal" is generally referred to as toward the backhead end of the DHD hammer, as illustrated in FIG. 1. Additionally, the term "a," as used in the specification, means "at least one." The terminology includes the words above specifically mentioned, derivatives thereof, and words of similar import.

In accordance with a preferred embodiment of the present invention, there is shown a DHD hammer that includes a housing 12, a backhead 14 and a tubular sliding check valve assembly 46, as best shown in FIGS. 1-4.

Figure 2:
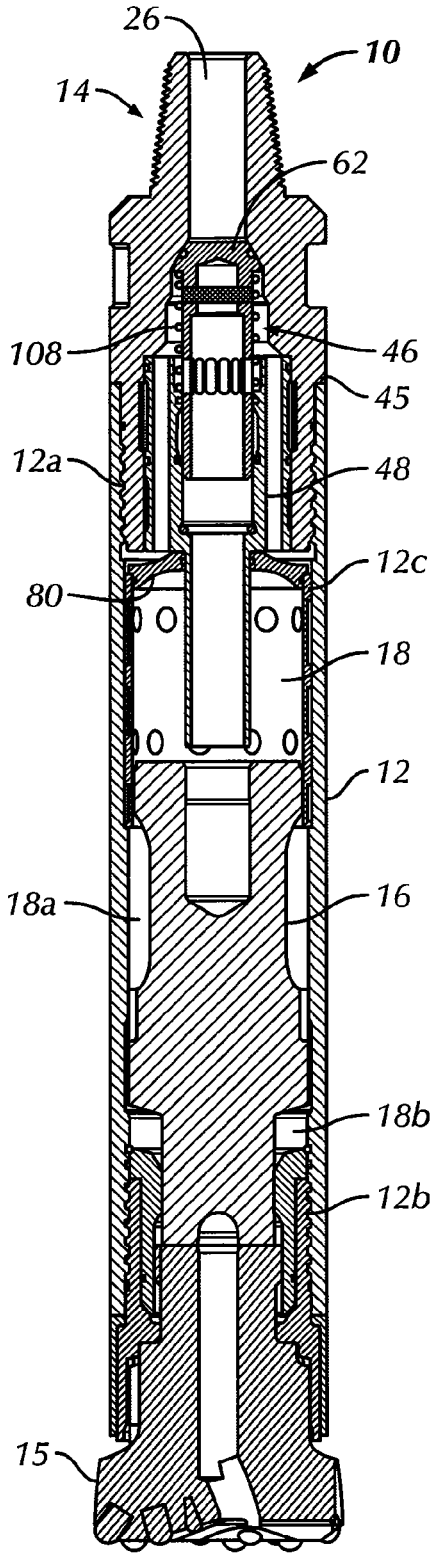
FIG. 2 is a cross-sectional, elevational view of the DHD hammer of FIG. 1.

The housing 12 is generally cylindrical and configured to receive a portion of the backhead 14 and a portion of a drill bit 15, as best shown in FIG. 1. The structure and operation of the housing 12 is known in the art and therefore a detail description of the housing 12 is not necessary for complete understanding of the present invention. However, as shown in FIG. 2, the housing 12 includes internal threads 12*a* and 12*b* about its proximal end and distal end, respectively. The threads 12*a* and 12*b* provide for a threaded connection of the backhead 14 and the assembly of the drill bit 15 to the housing 12.

Figure 4:
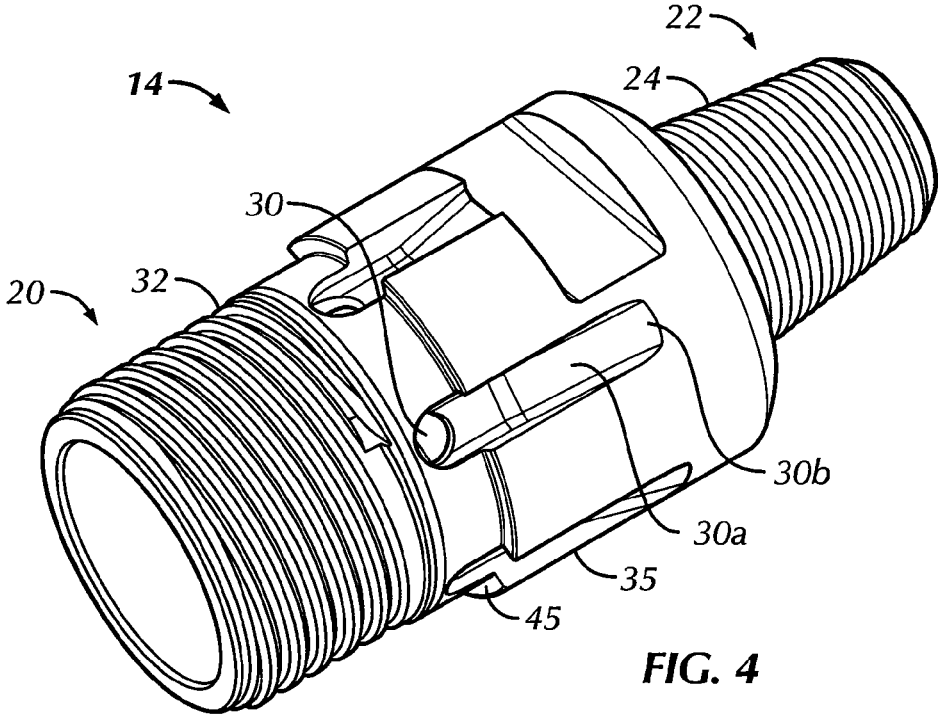
FIG. 4 is a perspective view of a backhead of the DHD hammer of FIG. 1.

The backhead 14 is generally configured, as shown in FIGS. 1-6. Referring to FIG. 4, the backhead 14 includes a proximal end 22, a mid portion 35 and a distal end 20. The proximal end 22 is generally configured as a tool-joint connection for assembly to a drill string or other tool (not shown) as known in the art. The proximal end 22 also includes male threads 24 for securing the proximal end 22 to the drill string (not shown). The distal end 20 includes threads 20 on the exterior surface for connecting with the housing 12 via the housing threads 12*a*.

Figure 3:
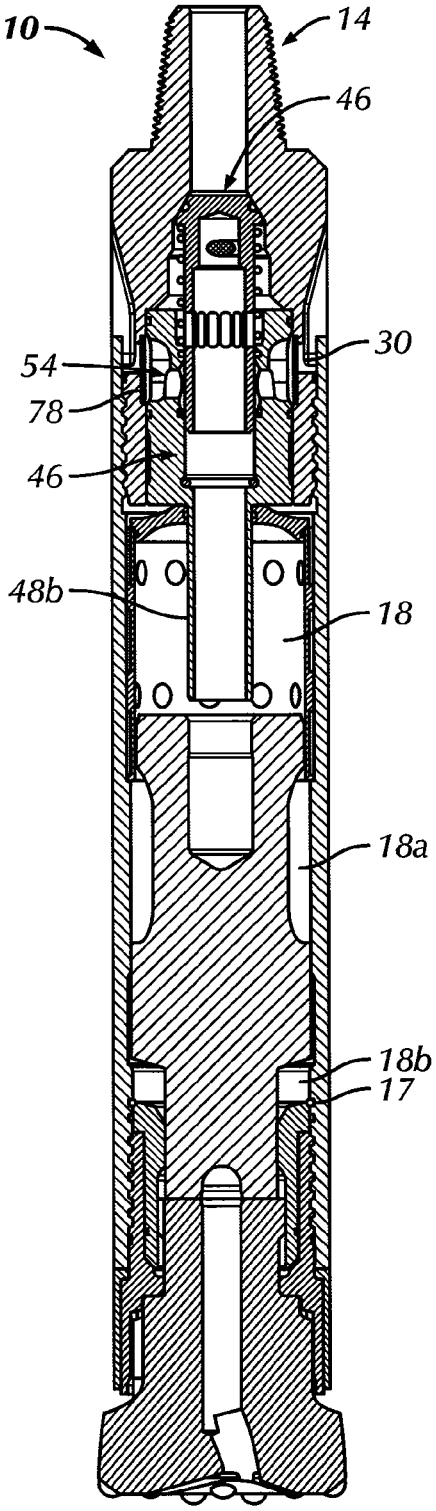
FIG. 3 is a cross-sectional, elevational view of the DHD hammer of FIG. 1 with a cross-section taken through an exhaust port of a backhead.

The tubular sliding check valve assembly 46, is shown in FIGS. 2 and 3. The tubular sliding check valve assembly 46 includes a distributor 48, a sliding valve 62 and a biasing member 108. The tubular sliding check valve assembly 46 is housed within the housing 12 proximate the backhead 14. When fully assembled within the DHD hammer 10, the tubular sliding check valve assembly 46 is housed partially within the backhead 14 and partially within the proximal end of the housing 12.

Figure 5:
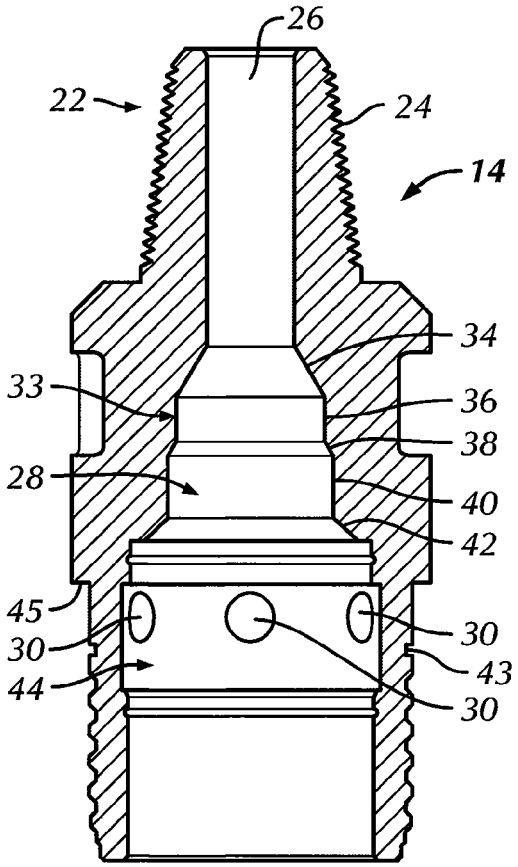
FIG. 5 is a cross-sectional, elevational view of the backhead of FIG. 4.
Figure 6:
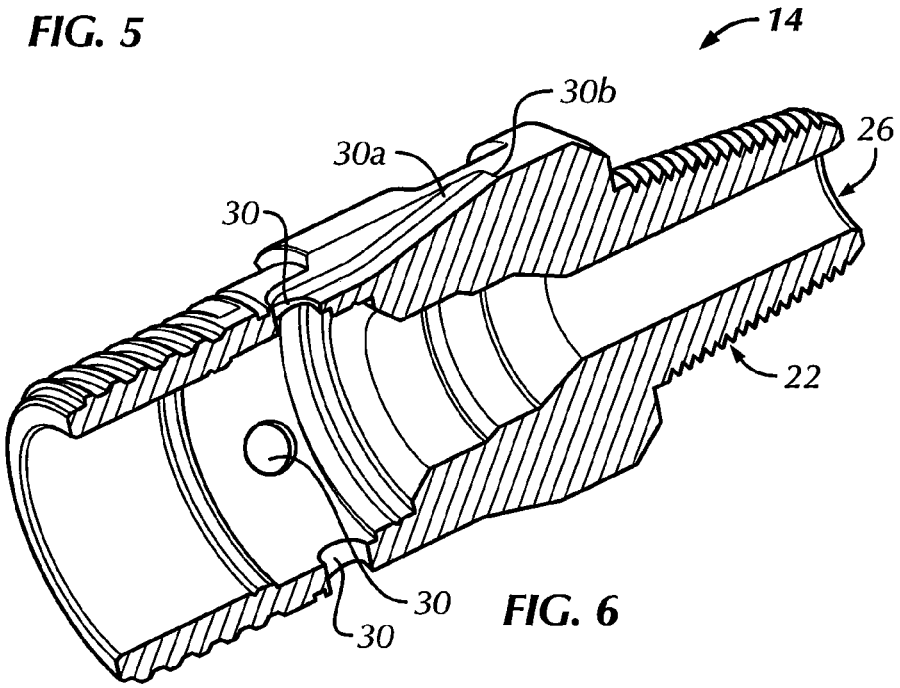
FIG. 6 is a perspective, cross-sectional view of the backhead of FIG. 4.

Referring to FIGS. 5 and 6, the backhead 14 also includes a supply inlet 26 that extends from the proximal end 22 to an interior region 28 of the backhead 14. Supply pressures of about 150 to 450 pounds per square inch (p.s.i.) are typically supplied to the DHD hammer 10 through the supply inlet 26. The interior region 28 of the backhead 14 is configured, as best shown in FIG. 5, and includes a tapered midsection 33 and a tubular distal end 44. The interior of the tapered midsection 33 tapers inwardly in the proximal direction. The tapered midsection 33 includes a first frustroconical shaped wall section 34 that is adjacent the supply inlet 26. Adjacent the first frustroconical wall section 34 is a first tubular wall section 36. A second frustroconical shaped wall section 38 is adjacent the first tubular wall section 36. Adjacent the second frustroconical wall section 38 is a second tubular wall section 40. Adjacent the second tubular wall section 40 is a third frustroconical shaped wall section 42. Preferably, the first frustroconical wall section 34 is distal to the supply inlet 26. Furthermore, the first tubular wall section 36 is distal to the first frustroconical wall section 34, the second frustroconical wall section 38 is distal to the first tubular wall section 36, the second tubular wall section 40 is distal to the second frustroconical wall section 38, and the third frustroconical wall section 42 is distal to the second tubular wall section 40.

The configuration of the tapered midsection 33 in combination with the sliding valve 62 (shown in FIG. 11 and described below) advantageously provides for an expandable inlet passageway 41 (FIG. 20) between the backhead 14 and the sliding valve 62 for communicating between the supply inlet 26 and a plurality of apertures 52 (FIG. 8) extending through the distributor 48, as further described below. That is, as the applied supply pressure of working fluids supplied by the drill string pressurizes the sliding valve 62, the sliding valve 62 moves distally within the tapered midsection 33. As the sliding valve 62 travels or slides distally, the inlet passageway 41 expands due to the distally expanding interior wall surface profile defined by the progression of frustroconical and tubular wall sections 34, 36, 38, 40 and 42.

The overall diameter of the sliding valve 62 is sized to provide a relatively small clearance of flow around the sliding valve 62 until an upper portion 62*a* (i.e., a frustroconical portion) of the sliding valve 62 (FIG. 11) moves distally past the second frustroconical wall section 38. Preferably, the clearance between the outside surface of the upper portion 62*a* and the interior wall surface of the interior 28 is about 0.02 to 0.05 inches, and more preferably about 0.03 inches.

In general, the inlet passageway 41 is in communication between the supply inlet 26 and the apertures 52 of the distributor 48 when the sliding valve 62 is in the open position. The inlet passageway 41 is formed between the surfaces of the chamfered proximal end of the sliding valve 62 and at least the frustroconical wall 34 and tubular wall 36 of the interior 28 of the backhead 14.

Figure 20:
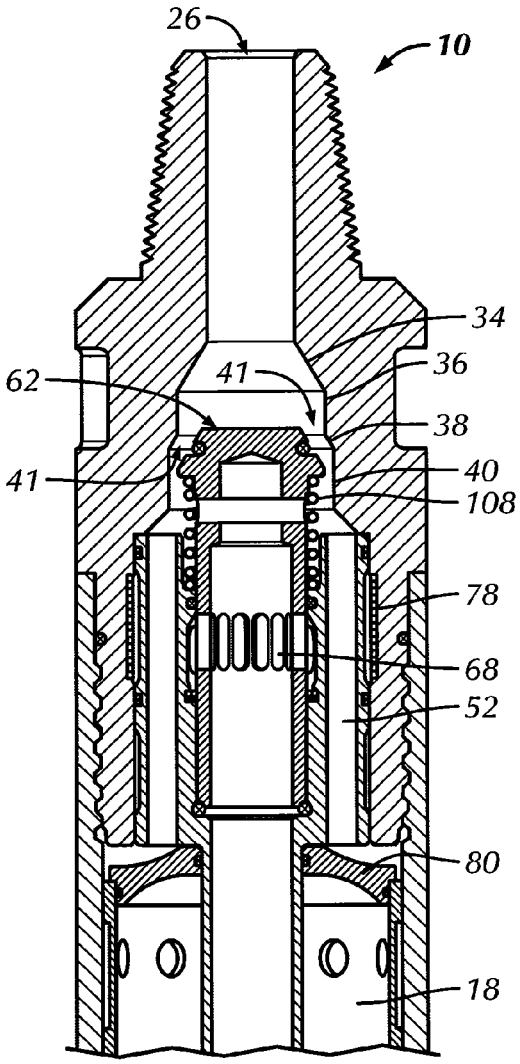
FIG. 20 is an enlarged, cross-sectional, elevational view of an upper portion of the DHD hammer of FIG. 1 showing the sliding valve in an open position.

The expandable inlet passageway 41 advantageously ensures that the supply of working fluid volumes into the backhead 14 adequately compresses or forces the biasing member 108 to move the sliding valve 62 to the fully open position (FIG. 20). This is a key feature of the tubular sliding check valve assembly 46, because without the expandable inlet passageway 41, the sliding valve 62 can become stuck in mid-stroke or in only a partially opened position due to the pressure forces above and below the sliding valve 62 equalizing during the movement of the sliding valve 62 to the fully open position.

The tubular distal end 44 of the backhead 14 is configured, as best shown in FIG. 5 and is distal to the tapered midsection 33. The tubular distal end 44 is configured to receive the distributor 48. About a proximal end of the tubular distal end 44 is an exhaust port 30 that extends radially from the interior 28 through the wall of the tubular distal end 44. As such, the exhaust port 30 provides for fluid communication between the interior 28 and an exterior of the backhead 14 (FIG. 3). Preferably, the backhead 14 includes a plurality of exhaust ports 30, and more preferably, six exhaust ports 30. The plurality of exhaust ports 30 are circumferentially and equally spaced apart. The exhaust ports 30 also include a groove or galley 30*a* that extends from an external surface of the backhead 14 towards the proximal end, as best shown in FIG. 4. The galley 30*a* is configured with a substantially rectangular or oblong shape that is inset within the wall of the backhead 14. As best shown in FIG. 6, a proximal end of the galley 30*a* extends or tapers radially and outwardly in the proximal direction and terminates at an outlet end 30*b* that is proximate the housing 12 (FIG. 3).

The backhead 14 also includes a flange 45 that extends radially inwardly from an outside surface of the mid portion 35 to the distal end 20 of the backhead 14. As best shown in FIG. 4, the flange 45 is positioned above the exhaust ports 30. The flange 45 provides a distal surface that engages a proximal end of the housing 12, as best shown in FIG. 2.

Figure 7:
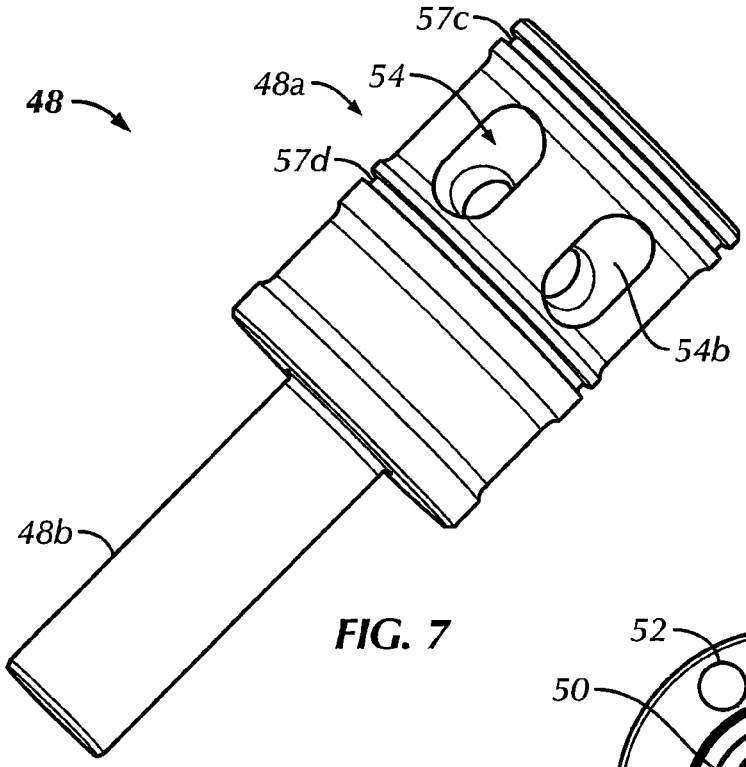
FIG. 7 is a perspective view of a distributor of the DHD hammer of FIG. 1.
Figure 8:
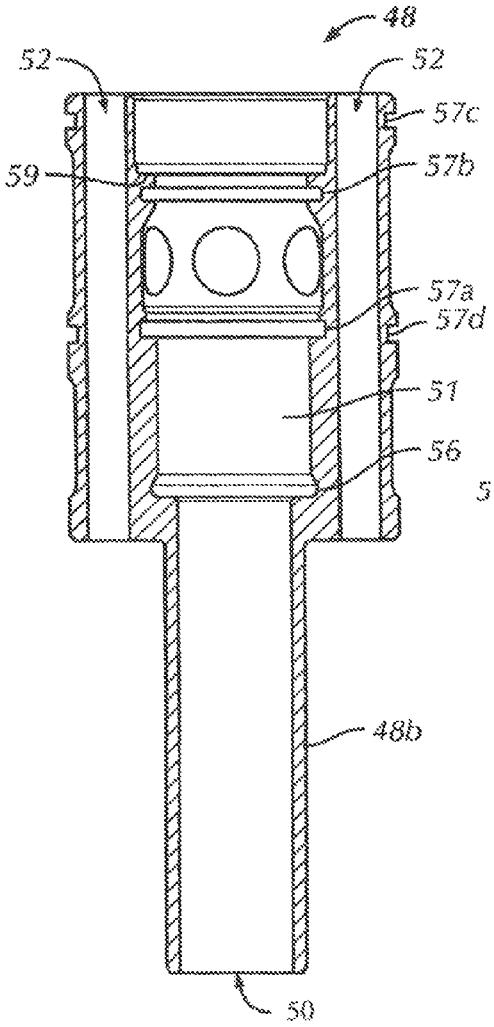
FIG. 8 is a cross-sectional, elevational view of the distributor of FIG. 7.

The distributor 48, is best shown in FIGS. 7-10. The distributor 48 includes a main body portion 48*a* and an exhaust stem 48*b* that is configured to extend into the drive chamber 18 of the DHD hammer 10. The distributor 48 also includes a central opening 50 that extends axially through the distributor 48, as shown in FIG. 8 and opens up to form an interior 51 of the main body portion 48*a*. As such, the central opening 50 provides for fluid communication between the proximal end and the distal end of the distributor 48.

Figure 10:
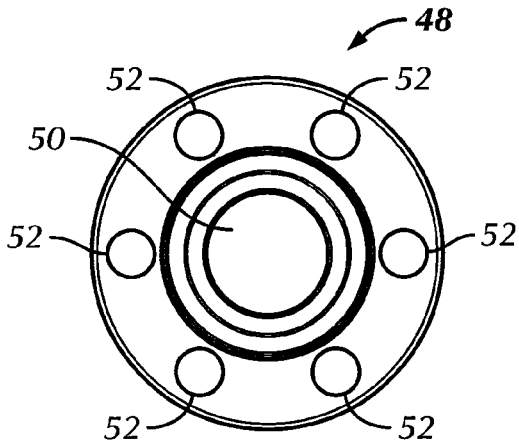
FIG. 10 is a top plan view of the distributor of FIG. 7.

The distributor 48 further includes an aperture 52 that extends through the distributor 48 in an axial direction. The aperture 52 is radially offset from the central opening 50, as shown in FIG. 8. The aperture 52 provides for fluid communication through the distributor 48, as further discussed below. Preferably, the distributor 48 includes a plurality of apertures 52, and more preferably the distributor 48 includes six apertures 52 that are circumferentially and equally spaced apart, as shown in FIG. 10.

Figure 9:
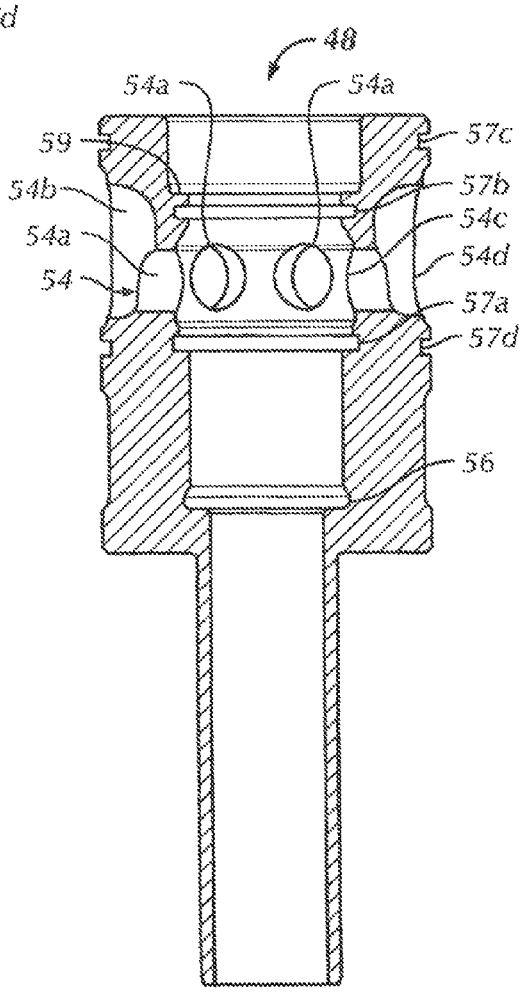
FIG. 9 is a cross-sectional, elevational view of the distributor of FIG. 7 with a cross-section taken through an exhaust gallery.

The distributor 48 also includes an exhaust gallery 54, as shown in FIGS. 7 and 9. The exhaust gallery 54 is configured with a first opening 54*a*, an enlarged opening 54*b* adjacent the opening 54*a* and an inlet opening 54*c* adjacent the first opening 54*a* at an end of the first opening 54*a* opposite the enlarged opening 54*b*. The first opening 54*a* is in communication with the interior 51 of the distributor 48 and the enlarged opening 54*b*. The exhaust gallery 54 also provides for fluid communication between the central opening 50 and the exhaust port 30 of the backhead, as shown in FIG. 3.

The distributor 48 preferably includes glands 57*a-d* that each receives a respective seal, as further described below. Gland 57*a* receives a seal 94 (FIG. 19) and is positioned about an interior wall surface of the interior 51 and below or distal to the inlet opening 54*c* while the gland 57*b* receives a seal 92 (FIG. 19) and is positioned about the interior wall surface of the interior 51 and above or proximal to the inlet opening 54*c*. The glands 57*a* and 57*b* and their respective seals sealingly engage an outer surface of the sliding valve 62. The gland 57*c* is positioned along an outer wall surface of the distributor 48 and above the enlarged opening 54*b* while the gland 57*d* is positioned along the outer wall surface of the distributor 48 and positioned below the enlarged opening 54*b*. Furthermore, the distributor 48 includes a gland 56 about a distal end of the interior 51 and a radially inwardly extending flange 59 about a proximal end of the main body portion 48*a* above the first openings 54*a*.

The sliding valve 62, is best shown in FIGS. 2 and 11-14. The sliding valve 62 is assembled within the interior 51 of the distributor 48, as best shown in FIG. 2. When fully assembled within the DHD hammer 10, the sliding valve 62 is slidable along the interior 51 of the distributor 48 and movable between a closed position and an open position, as further discussed below.

Figure 14:
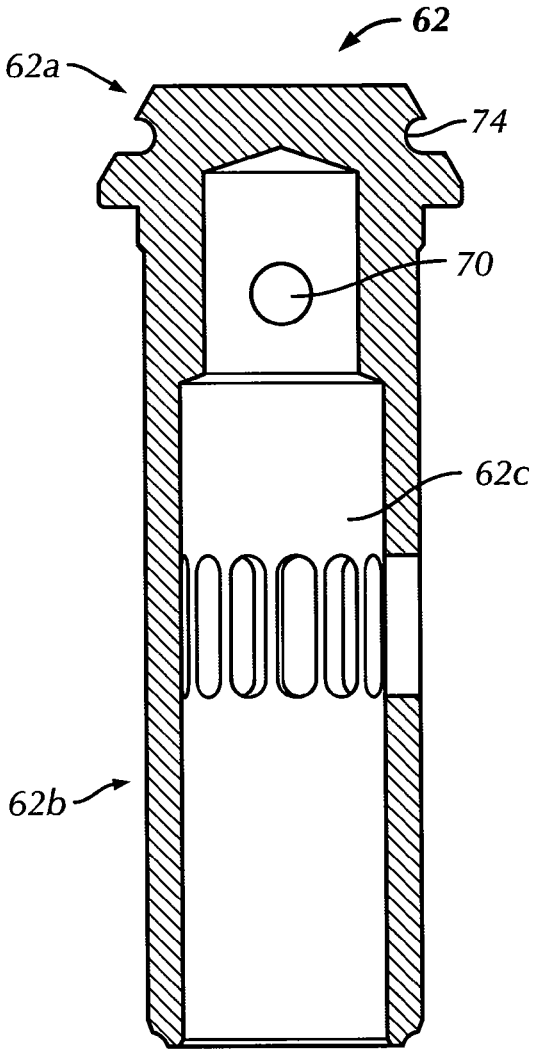
FIG. 14 is a cross-sectional, elevational view of the sliding valve of FIG. 11.

The sliding valve 62 includes a closed proximal end 64 (FIG. 12), an open distal end 66 (FIG. 11) and an opening 68 about a midsection of the sliding valve 62. The opening 68 extends radially through the wall of the sliding valve 62, as best shown in FIGS. 11 and 14. The opening 68 is configured as an elongated opening about a mid portion of the sliding valve 62. Preferably, the sliding valve 62 including a plurality of openings 68 that are circumferentially spaced apart about the mid portion of the main body portion 62*b*. The position of the opening 68 along the sliding valve 62 is configured such that when the sliding valve 62 is moved to the open position, the opening 68 provides for fluid communication between the interior 51 of the distributor 48 and the exhaust gallery 54. However, when the sliding valve 62 moves to the closed position, the opening 68 is spaced apart from the exhaust gallery 54 such that the bottom portion of the sliding valve 62 sealingly engages the seals 92 and 94 to seal off the inlet opening 54*c*.

Figure 15:
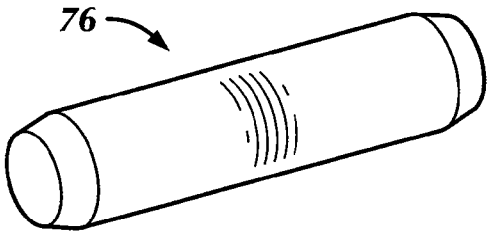
FIG. 15 is a perspective view of a dowel for assembly within the sliding valve of FIG. 11.

In general, the sliding valve 62 includes an upper portion 62*a* and a main body portion 62*b*. The upper portion 62*a* is generally configured as a frustroconical portion or as a chamfered proximal end. The main body portion 62*b* is generally configured as a tubular portion extending distally from the upper portion 62*a*. The sliding valve 62 is configured with a hollow interior 62*c* and a through hole 70 that extends through a proximal end of the main body portion 62*b*. The through hole 70 is configured to receive a dowel 76 (FIG. 15). The dowel 76 serves as a bypass plug or a choke plug for the sliding valve 62, as known in the art. The sliding valve 62 can optionally be configured with a gland 74 recessed about an outer surface of the frustroconical upper portion 62*a*. The upper portion 62*a* also includes a distal surface 72 that extends radially inwardly to the exterior wall of the main body portion 62*b*.

The assembly of the sliding valve 62 within the DHD hammer 10, owing to the openings 68 of the sliding valve 62 being in communication with the exhaust ports 30, advantageously ensures that the interior 62*c* is substantially at exhaust pressure or the pressure external to DHD hammer 10, which is significantly less (e.g., at about atmospheric pressure or about 0-50 p.s.i.) than the supply pressure (e.g., about 300-350 p.s.i. or about 150 to 450 p.s.i.) being fed to the DHD hammer 10 via the supply inlet 26. Thus, because the pressure within the sliding valve 62 is maintained at lower pressures, relative to the supply pressure of working fluid volumes fed to the DHD hammer 10, the tubular sliding check valve assembly 46 advantageously ensures that the supply pressure functions as a bias pressure to urge the tubular sliding check valve assembly 46 to the open position.

The biasing member 108 is assembled to the tubular sliding check valve assembly 46 so as to be positioned between the sliding valve 62 and the distributor 48, as best shown in FIG. 2. The biasing member 108 can be any biasing member know in the art and preferably a coil spring biasing member 108. A proximal end of the biasing member 108 engages the distal end 72 of the sliding valve 62 while the distal end of the biasing member 108 engages the flange 59 extending radially inwardly from the upper portion of the distributor's interior 51.

Preferably, the biasing member 108 is configured to provide an overall restoring force to the sliding valve 62 sufficient to retain an elevated pressure of at least 35 p.s.i. within the DHD hammer 10. This can be accomplished with a biasing member 108 the provides a net restoring force in lbs. that is about 90% to 125% of the numerical valve of the DHD hammer's internal diameter squared. The term "net restoring force" means the overall force applied to the sliding valve 62 by the biasing member 108 minus any counterforces acting on the sliding valve 62, such as frictional forces generated by seals on the sliding valve 62. Configuring the biasing member 108 to have a net restoring force of about 90% to 125% of the numerical valve of the DHD hammer's internal diameter squared advantageously allows the biasing member 108 to move the sliding valve 62 to the closed position (FIG. 2) when a flow of supply pressure fed through the supply inlet 26 is discontinued, thereby sealing off the supply inlet 26, while the internal pressure within the DHD hammer 10 is maintained at elevated pressures e.g., at or above 35 p.s.i. Elevated pressures are maintained within the DHD hammer 10 in combination with a seal 17 and a solid-core piston 16, as further described below.

Thus, for example, Table 1 illustrates the preferred net restoring force ranges for the biasing member 108 over a range of DHD hammer 10 bore sizes.

TABLE 1

| Internal Diameter DHD Hammer (inches) | Net Restoring Force Range (lbs.) [provided by biasing member to sliding valve] |
|---|---|
| 4.6 | 19.3-26.7 |
| 3 | 8.1-11.25 |
| 4 | 14.4-20.0 |
| 5 | 22.5-31.25 |
| 6 | 32.4-45.0 |
| 8 | 57.6-80.0 |

During operation of the DHD hammer 10, the flow of working fluid or supply pressure pressurizes the internal areas of the DHD hammer 10 to elevated pressures above 35 p.s.i., and typically operates the DHD hammer 10 at pressures from about 150 p.s.i. to 450 p.s.i. Thus, with a biasing member 108 having a sufficient net restoring force, the biasing member 108 allows the DHD hammer 10 to partially retain the elevated pressures within the DHD hammer's internal areas, such as the drive chamber 18 at elevated pressures. Preferably, the internal areas of the DHD hammer 10 are maintained at a pressure of at least 35 p.s.i. by the proper balancing of the net restoring force of the biasing member 108 on the sliding valve 62.

Figure 25:
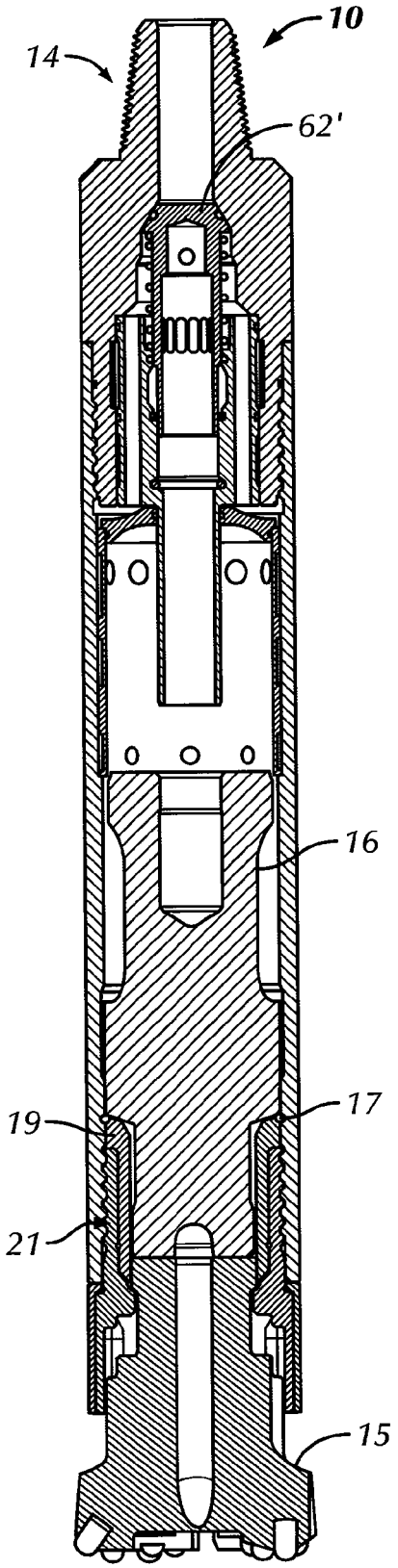
FIG. 25 is a cross-sectional, elevational view of the DHD hammer of FIG. 22A in a drop-down position.

The internal areas of the DHD hammer 10, such as the drive chamber 18, are sealed off, and preferably hermetically sealed, owing to the combination of the solid-core piston 16 and the seal 17, when the DHD hammer 10 is in a drop-down position. The DHD hammer 10 is sealed off and moved to the drop-down position upon the flow of supply pressure feed to the DHD hammer 10 being discontinued i.e., stopped or reduced to a non-actuating level, such as 35 p.s.i. FIG. 25 illustrates the DHD hammer 10 in the drop-down position. Maintaining the internal areas of the DHD hammer 10 at elevated pressures advantageously prevents the ingress of water and debris into the DHD hammer's interior, which can negatively impact the overall operation and startup of the DHD hammer 10 after an intermittent stop. Typically, well bores can generate a water column to heights of up to 80 feet of water, or about 35 p.s.i. Thus, maintaining the internal areas of a DHD hammer 10 at or above 35 p.s.i. upon an intermitted stop advantageously prevents the ingress of water and debris into the DHD hammer 10 when situated at a well bore bottom.

Figure 26:
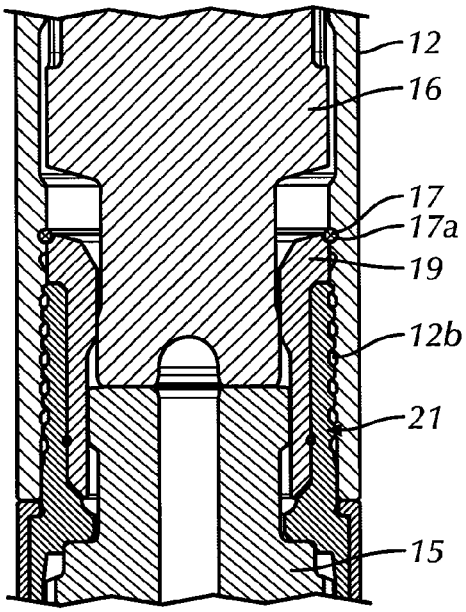
FIG. 26 is an enlarged, cross-sectional, elevational view of a lower portion of the DHD hammer of FIG. 1.
Figure 24:
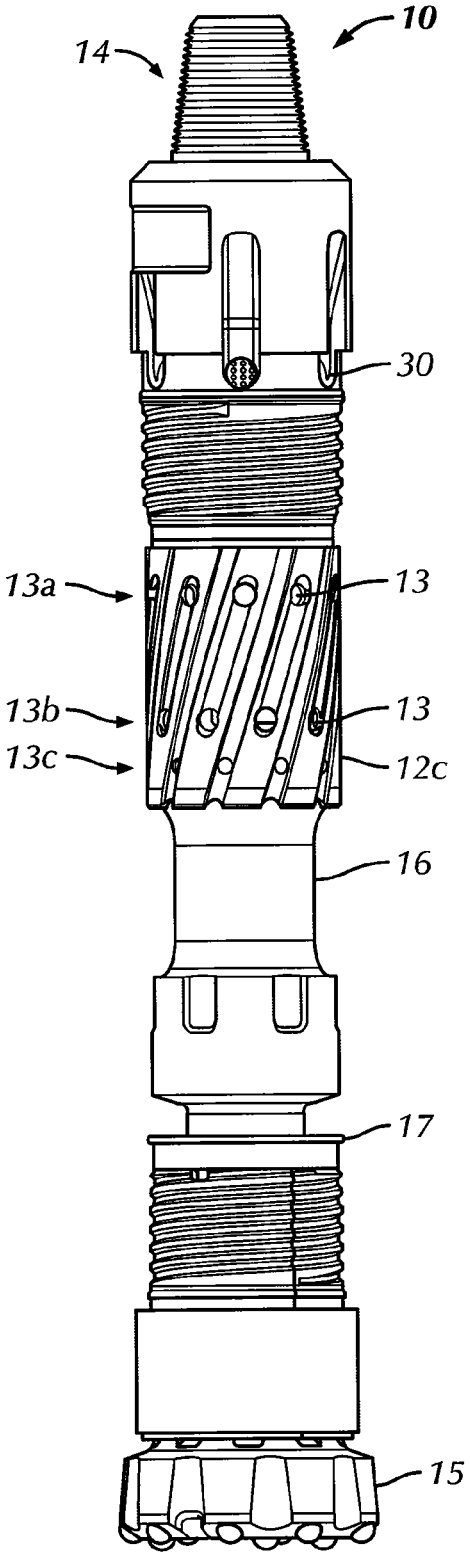
FIG. 24 is an elevational view of the DHD hammer of FIG. 1 without a housing.

The seal 17 is best shown in FIGS. 24-26. The seal 17 is housed within a gland 17*a* of the housing 12 located about a distal end of the housing 12 and above the threads 12*b*. The seal 17 is preferably positioned so as to be engaged with a cylindrical bearing 19 located about the distal end of the housing 12 and configured to receive a distal end of the piston 16. The cylindrical bearing 19 is seated on a chuck assembly 21 that threadedly engages the housing 12 and retains the drill bit 15. Referring to FIG. 25, when the DHD hammer 10 is in the drop down position, the solid-core piston 16 engages the seal 17, thereby preventing the ingress of external fluid and debris into the internal areas of the DHD hammer 10.

Figure 11A:
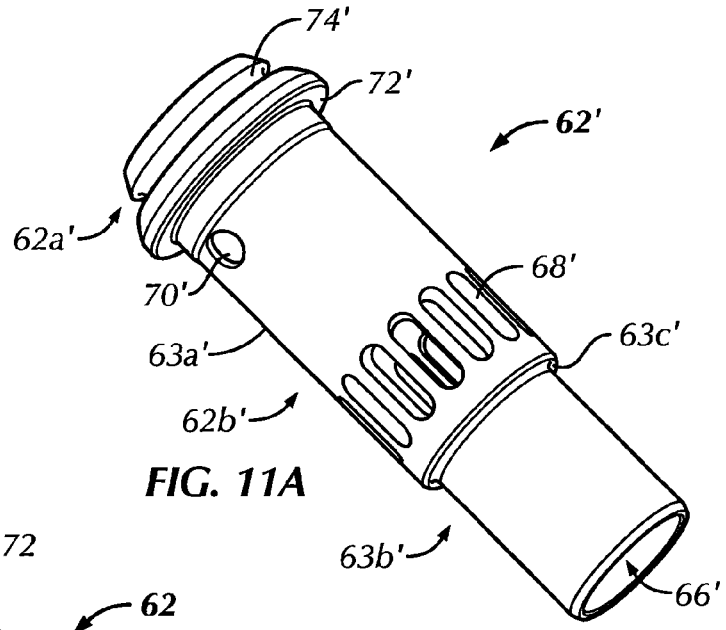
FIG. 11A is a bottom perspective view of an alternative embodiment of a sliding valve of a DHD hammer of FIG. 19A.
Figure 11:
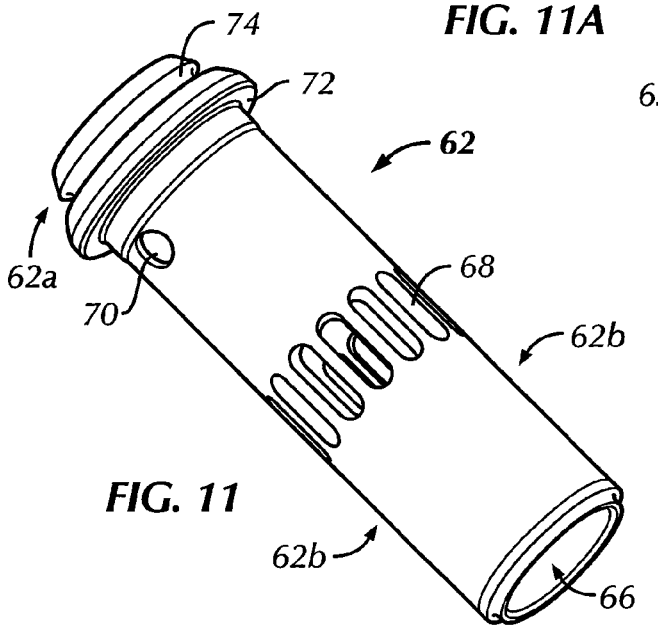
FIG. 11 is a bottom perspective view of a sliding valve of the DHD hammer of FIG. 1.
Figure 12:
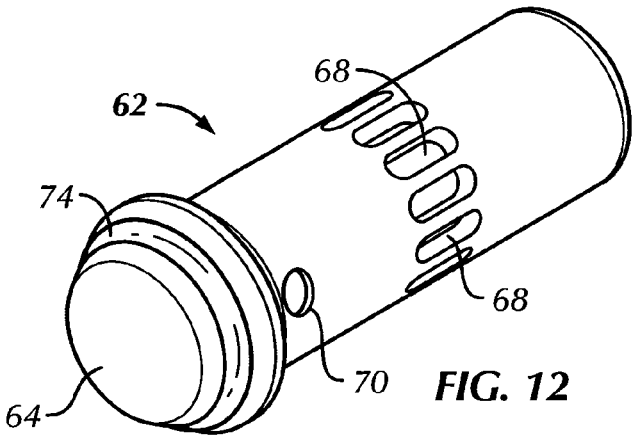
FIG. 12 is a top perspective view of the sliding valve of FIG. 11.
Figure 13:
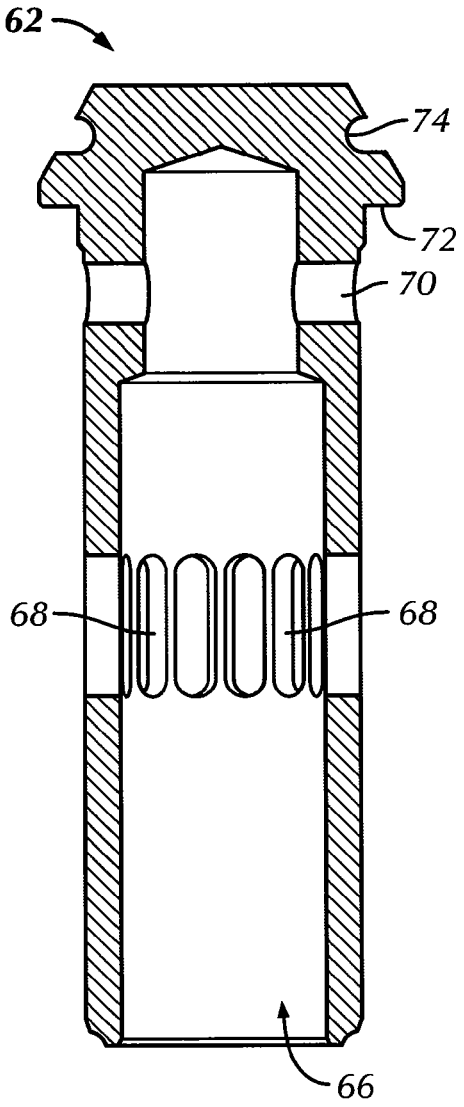
FIG. 13 is a cross-sectional, elevational view of the sliding valve of FIG. 11 with a cross-section taken through a through hole of the sliding valve.
Figure 19:
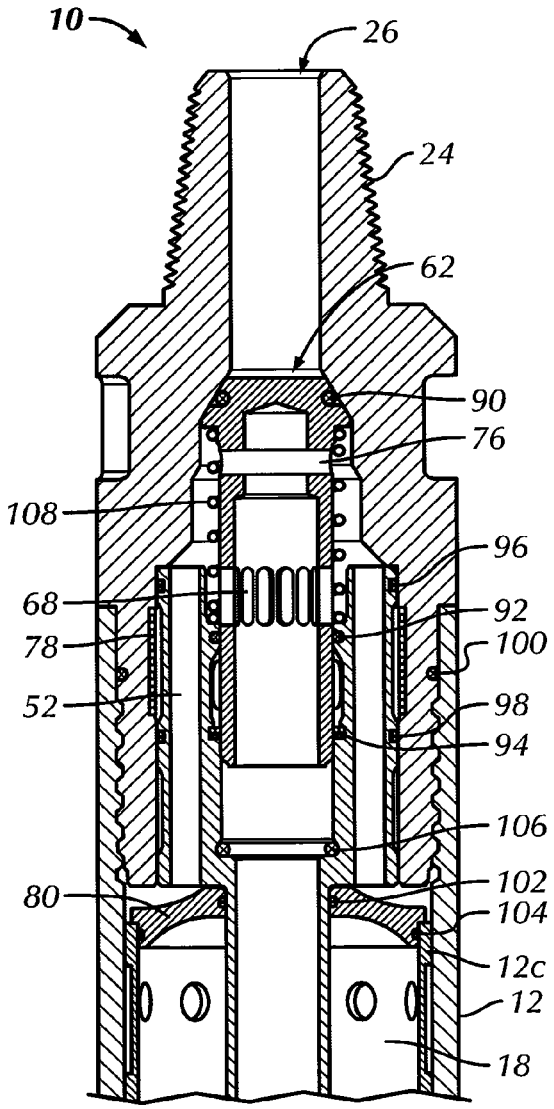
FIG. 19 is an enlarged, cross-sectional, elevational view of an upper portion of the DHD hammer of FIG. 1 showing the sliding valve in a closed position.
Figure 19A:
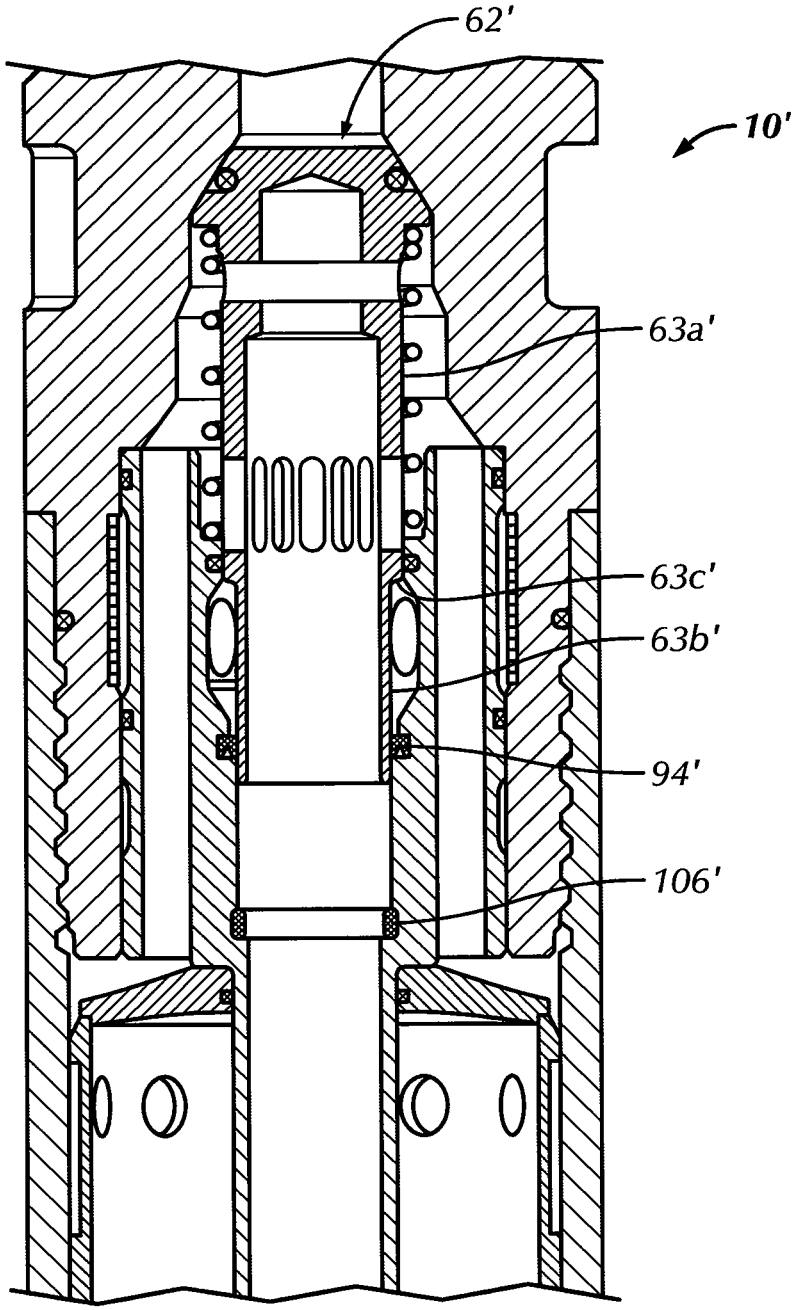
FIG. 19A is an enlarged, cross-sectional, elevational view of an upper portion of a DHD hammer showing the sliding valve of FIG. 11A in a closed position, in accordance with another embodiment of the present invention.
Figure 22:
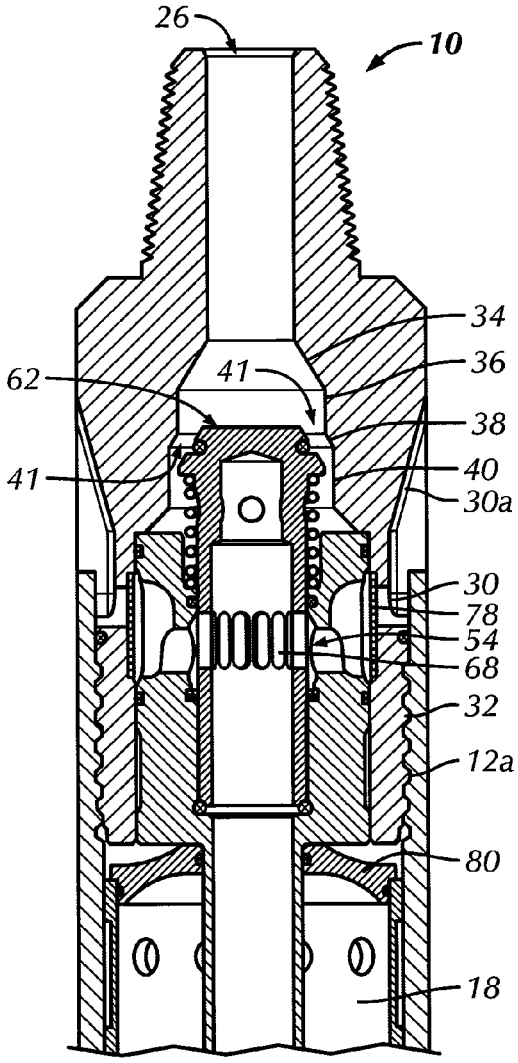
FIG. 22 is an enlarged, cross-sectional, elevational view of an upper portion of the DHD hammer of FIG. 1 showing the sliding valve in an open position and with a cross-section taken through exhaust ports of the backhead.
Figure 22A:
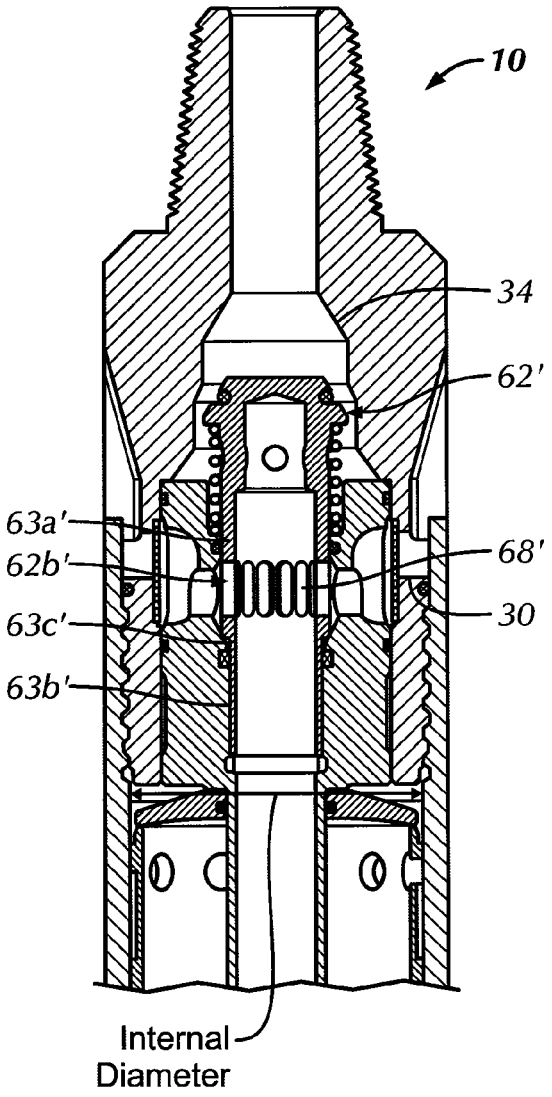
FIG. 22A is an enlarged, cross-sectional, elevational view of an upper portion of a DHD hammer that includes the sliding valve of FIG. 11A.

FIGS. 11A, 19A and 22A illustrate an alternative sliding valve 62' embodiment that is similar to the sliding valve 62, except for the inclusion of a reduced diameter lower body portion 63*b*'. That is, the main body portion 62*b*' includes an upper body portion 63*a*' and the lower body portion 63*b*'. The lower body portion 63*b*' has an overall diameter that is smaller then the upper body portion 63*a*'. The main body portion 62*b*' also includes a stepped flange having a distally facing surface 63*c*' that forms the transition between the upper body portion 63*a*' and the lower body portion 63*b*'. The stepped flange is positioned distal to the openings 68'. The distally facing surface 63*c*' advantageously provides for a distally facing surface area i.e., a bias area 63*c*', which is exposed to exhaust pressure (which is less the supply pressure) to ensure that the sliding valve 62' moves distally to the open position upon exposure to supply pressure (see also FIG. 22A).

The distally facing surface area 63*c*' is preferably about 2-4% of the numerical valve of the DHD hammer's internal diameter squared. Table 2, illustrates the preferred distally facing surface area 63*c*' over a range of DHD hammer bore sizes.

TABLE 2

| Internal Diameter DHD Hammer (inches) | Distally Facing Surface Area Range (in.$^2$) |
|---|---|
| 4.6 | 0.43-0.86 |
| 3 | 0.18-0.36 |
| 4 | 0.32-0.64 |
| 5 | 0.50-1.00 |
| 6 | 0.72-1.44 |
| 8 | 1.28-2.56 |

The combination of the distally facing surface area 63*c*' of the sliding valve 62' and the net restoring force of the biasing member 108 advantageously allows the DHD hammer 10 to retain elevated pressures within its internal areas at or above 35 p.s.i. upon an intermittent stop of the DHD hammer 10. This is accomplished by the proper balancing of the net restoring force of the biasing member 108 on the sliding valve 62' and the bias area 63*c*' of the sliding valve 62' in combination with the expandable inlet passageway 41 of the backhead 14.

Figure 16:
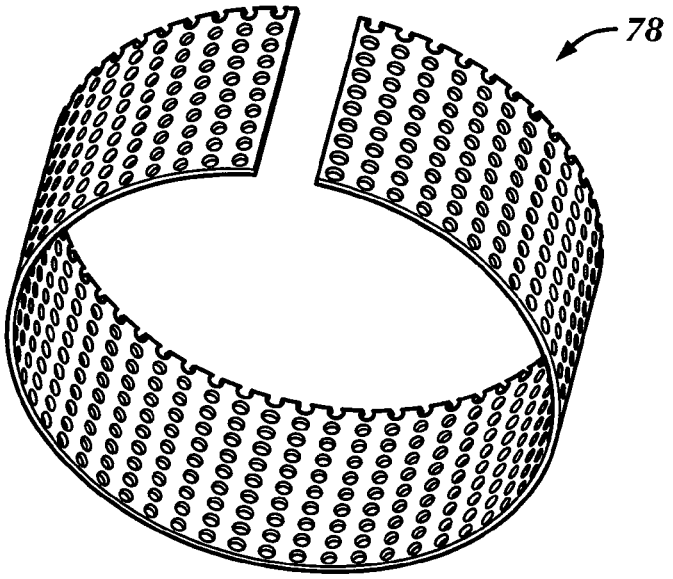
FIG. 16 is a perspective view of a screen of the DHD hammer of FIG. 1.

Referring to FIGS. 3, 9 and 16, the DHD hammer 10 can optionally include a screen 78. The screen 78 is configured, as best shown in FIG. 16, and is preferably configured as a perforated plate screen. The screen 78 is preferably configured as a split ring screen for circumscribing the distributor 48 about an outlet 54*d* of the exhaust gallery 54. As best shown in FIG. 3, the screen 78 is sized and configured to circumscribe the exhaust gallery's enlarged opening 54*b*. The screen 78 advantageously provides a means to screen out and prevent debris from entering the DHD hammer's interior through the exhaust ports 30 of the backhead 14.

Figure 17:
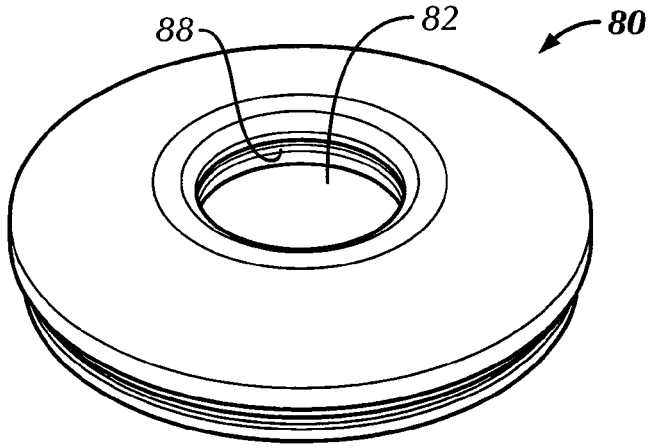
FIG. 17 is a perspective view of a belleville washer of the DHD hammer of FIG. 1.
Figure 18:
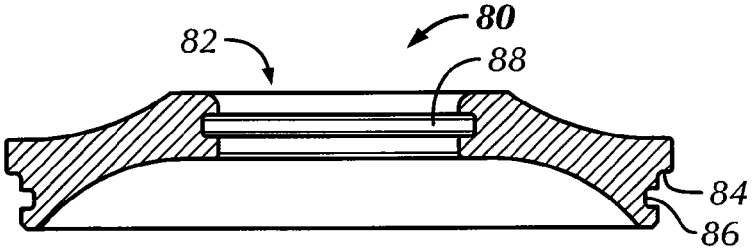
FIG. 18 is a cross-sectional, elevational view of the belleville washer of FIG. 17.

The DHD hammer 10 also includes a belleville washer 80 for facilitating the mounting of the tubular sliding check valve assembly 46 within the housing 12 and the backhead 14. The belleville washer 80 is configured, as best shown in FIGS. 2, 17 and 18. The belleville washer 80 includes a central through hole 82 and glands 86 and 88. The gland 88 is configured about a surface of the central through hole 82 for receiving a seal 102 (FIG. 19). The belleville washer 80 also includes a distally facing flange 84 about a mid portion along its axial length, as shown in FIG. 18. The gland 86 is positioned below the flange 84 and configured to receive a seal 104 (FIG. 19). As shown in FIGS. 19 and 22, the belleville washer 80 is assembled within the housing 12 such that the flange 84 engages a proximal end of an inner housing 12*c* or sliding cylinder.

Figure 23:
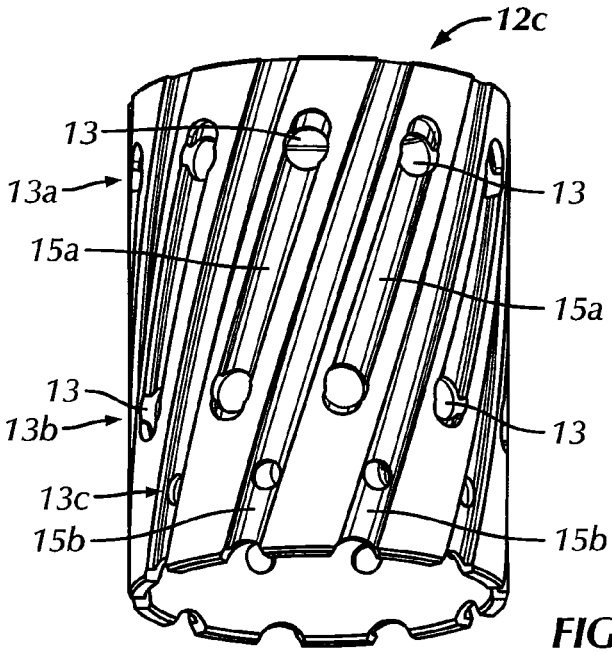
FIG. 23 is an enlarged, perspective view of an inner housing of the DHD hammer of FIG. 1.

The inner housing 12*c* is preferably a separate component from the rest of the housing 12. The structure, operation and assembly of the inner housing 12*c* is known in the art and therefore a detailed description of the inner housing 12*c* is not necessary for complete understanding of the present invention. However, as best shown in FIG. 23, the inner housing 12*c* is generally configured as a cylindrical housing having a plurality of spaced apart through holes 13 about the wall of the inner housing 12*c*. The plurality of through holes 13 are arranged, as shown in FIG. 23, with a first row 13*a* of through holes 13 circumferentially and generally evenly spaced apart about a proximal end of the inner housing 12*c* and a second row 13*b* of through holes 13 circumferentially and generally evenly spaced apart about a distal end of the inner housing 12*c*. The position of the through holes 13 of the first row 13*a* are circumferentially offset from the position of the through holes 13 of the second row 13*b*. The inner housing 12*c* also includes a third row 13*c* of through holes 13 circumferentially and generally evenly spaced apart and located closer to the distal end of the inner housing 12*c* than the holes of the second row 13*b*. The third row 13*c* of through holes 13 are also circumferentially offset from the second row 13*b* of through holes 13.

A plurality of splines 15*a* are formed about the outer surface of the inner housing 12*c* that each connect a through hole 13 of the first row 13*a* to a through hole 13 of the second row 13*b*. Each spline 15*a* provides fluid communication for the flow of fluid between the through holes 13 of the first and second rows 13*a*, 13*b*. A plurality of splines 15*b* are also formed about the outer surface of the inner housing 12*c* that are each in fluid communication with the through holes 13 of the third row 13*c*. Each spline 15*b* allows for fluid to flow around the exterior of the inner housing 12*c*. As such, the splines 15*b* allow for the flow of working fluid volumes to flow from the drive chamber 18 though the through holes 13 of either the first, second or third row 13*a-c* to a reservoir chamber 18*a* (FIG. 2). Working fluid volumes then flow past the distal end of the piston 16 into and out of the return chamber 18*b* (FIG. 2). Owing to the circumferential offset of the through holes 13 of the first and third rows 13*a*, 13*c* from the second row 13*b*, the plurality of splines 15*a*, 15*b* are formed as helical splines.

Such features of the through holes 13 and splines 15*a*,15*b* of the inner housing 12*c* form part of the DHD hammer's porting system. The porting features of a DHD hammer function to move working fluid volumes between the DHD hammer's drive chamber 18, reservoir chamber 18*a* and return chamber 18*b* to reciprocatively move the DHD hammer's piston 16. In other words, the flow of working fluid volumes from the supply inlet 26, check valve assembly 46, drive chamber 18, reservoir chamber 18*b* and return chamber 18*b*, all function to drive the operation of the DHD hammer 10. FIG. 24 illustrates the assembly of the DHD hammer 10 without housing 12, showing the porting features of the instant invention.

FIGS. 19-22 best show the tubular sliding check valve assembly 46 fully assembled to the DHD hammer 10. FIG. 19 also illustrates the inclusion of seals 90, 92, 94, 96, 98, 100, 102 and 104 within their respective glands, as discussed above. The seals can be any seal readily known in the art, such as an elastomeric seal in the form of an O-ring seal or the like.

Figure 21:
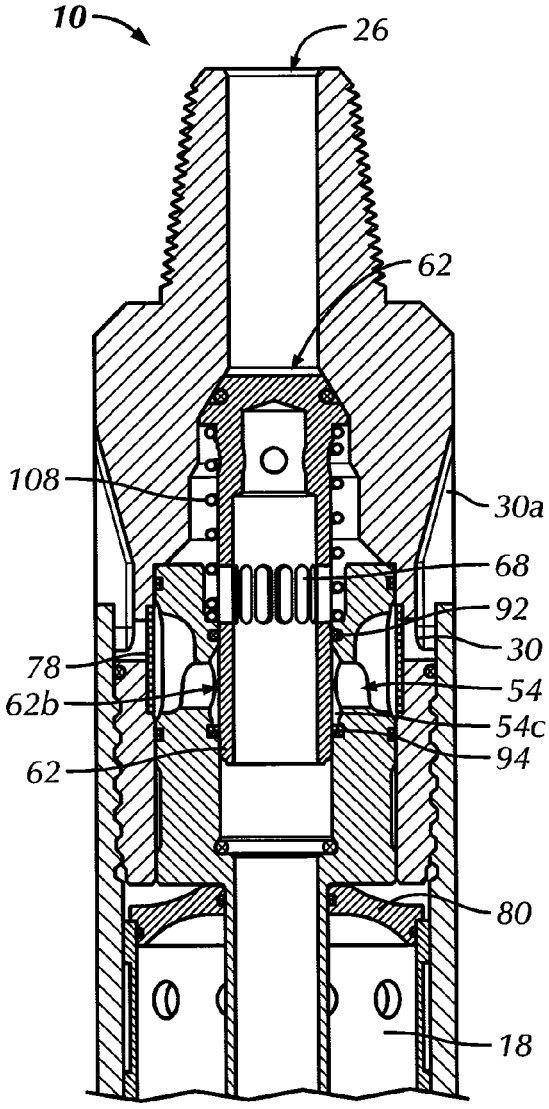
FIG. 21 is an enlarged, cross-sectional, elevational view of an upper portion of the DHD hammer of FIG. 1 showing the sliding valve in a closed position with a cross-section taken through exhaust ports of the backhead.

The biasing member 108 biases the sliding valve 62 to the closed position in the absence of a supply of working fluid volumes being fed through the supply inlet 26. The closed position is illustrated in FIGS. 19 and 21. In the closed position, the proximal end of the sliding valve 62, i.e., the chamfered end of the upper portion 62*a* sealingly engages the supply inlet 26. Preferably, the upper portion 62*a* of the sliding valve 62 sealingly engages the first frustroconical wall section 34 of the backhead 14. Furthermore, a distal portion of the sliding valve 62, below the openings 68, sealingly engages an inlet opening 54*c* of the exhaust gallery 54. The sealing engagement between the distal end of the sliding valve 62 and the exhaust gallery 54 is facilitated by seals 92 and 94. In this position, the tubular sliding check valve assembly 46 seals off the supply inlet 26 and any fluid communication between an exterior of the DHD hammer 10 and an interior of the DHD hammer 10 through the exhaust ports 30.

The open position of the tubular sliding check valve assembly 46, is best shown in FIGS. 20 and 22. In the open position, the sliding valve 62 is offset from the distal end of the supply inlet 26. Plus, the openings 68 are in communication with the exhaust gallery 54, as best shown in FIG. 22. Furthermore, as shown in FIG. 20, the supply inlet 26 is in communication with the apertures 52 extending through the distributor 48 to supply working fluid volumes to the DHD hammer's drive chamber 18.

Referring back to FIG. 2, the drill bit 15 is operatively connected to a distal end of the housing 12. The drill bit 15 can be operatively connected in a conventional manner known in the art and therefore a detailed description of such a connection is not necessary for a complete understanding of the present invention. However, an example of how the drill bit 15 can be operatively connected to the housing 12 is described in U.S. patent application Ser. No. 12/621,155, the disclosure of which is hereby incorporated by reference herein in its entirety.

The DHD hammer 10, as discussed above has been described and shown as including a solid-core piston 16. That is, the solid-core piston 16 lacks any through hole or central opening that extends completely through the piston, such as in the axial direction. However, the sliding check valve assembly 46 of the DHD hammer 10 can alternatively be used with any conventional piston having a central through hole that extends axially through the piston to allow exhaust through the piston and drill bit.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A down-the-hole drill hammer comprising:
- a housing;
- a backhead at a proximal end of the housing, the backhead including:
  - a distal end,
  - a threaded male proximal end,
  - a supply inlet for receiving a supply of working fluid to an interior of the backhead, and
  - an exhaust port for communicating between the interior of the backhead and an exterior of the backhead; and
- a tubular sliding check valve assembly within the housing proximate to the backhead, the sliding check valve assembly including:
  - a distributor having:
    - a central opening,
    - an aperture extending through the distributor and offset from the central opening for allowing the passage of working fluid through the distributor, and
    - an exhaust gallery for communicating between the central opening and the exhaust port, and
  - a sliding valve slidable along the central opening and movable between a closed position and an open position, the sliding valve including:
    - a closed proximal end,
    - an open distal end, and
    - an opening about a midsection of the sliding valve, and
  - a biasing member biasing the sliding valve,
- wherein, in the closed position, the proximal end of the sliding valve sealingly engages the supply inlet and a distal end of the sliding valve sealingly engages an inlet opening of the exhaust gallery, and
- wherein, in the open position, the sliding valve is offset from the supply inlet, the openings of the sliding valve are in communication with the exhaust gallery, and the supply inlet is in communication with the aperture extending through the distributor.

2. The down-the-hole drill hammer of claim 1, further comprising:
- a drill bit operatively connected to a distal end of the housing; and
- a reciprocating solid-core piston within the housing between the sliding check valve assembly and the drill bit.

3. The down-the-hole drill hammer of claim 1, further comprising an expandable inlet passageway between the backhead and the sliding valve for communicating between the supply inlet and the aperture extending through the distributor.

4. The down-the-hole drill hammer of claim 3, wherein the expandable inlet passageway expands as the sliding valve slides distally relative to the backhead.

5. The down-the-hole drill hammer of claim 1, wherein the sliding valve has a chamfered proximal end.

6. The down-the-hole drill hammer of claim 5, wherein the interior of the backhead includes a frustroconical wall adjacent the supply inlet to engage the chamfered proximal end of the sliding valve.

7. The down-the-hole drill hammer of claim 6, wherein the interior of the backhead further includes a tubular wall adjacent to a distal end of the frustroconical wall.

8. The down-the-hole drill hammer of claim 7, wherein an inlet passageway in communication between the supply inlet and the aperture extending through the distributor is formed between the surfaces of chamfered proximal end of the sliding valve and the frustroconical wall and the tubular wall of the interior of the backhead.

9. The down-the-hole drill hammer of claim 8, wherein inlet passageway has an annular gap of about 0.02 to about 0.05 inches.

10. The down-the-hole drill hammer of claim 5, wherein the proximal end of the sliding valve includes a seal recessed within the chamfered proximal end.

11. The down-the-hole drill hammer of claim 1, wherein the distributor further includes a first seal proximal to the inlet opening of the exhaust gallery and a second seal distal to the inlet opening of the exhaust gallery, the first and second seals sealingly engaging an outer surface of the sliding valve.

12. The down-the-hole drill hammer of claim 1, wherein the distributor further includes a screen about an outlet end of the exhaust gallery.

13. The down-the-hole drill hammer of claim 1, wherein the exhaust port extends toward the proximal end of the housing and includes an outlet end proximate to the housing.

14. The down-the-hole drill hammer of claim 1, wherein the distributor further includes an exhaust stem extending into a drive chamber of the hammer.

15. The down-the-hole drill hammer of claim 1, further comprising a washer connected to the housing to secure the distributor within the interior of the backhead.

16. The down-the-hole drill hammer of claim 1, wherein the sliding valve includes a plurality of openings, the distributor includes a plurality of apertures extending through the distributor, and the backhead includes a plurality of exhaust ports.

17. The down-the-hole drill hammer of claim 1, wherein the backhead includes:

a tapered midsection interior in communication with the supply inlet; and a tubular distal end for receiving the distributor.

18. The down-the-hole drill hammer of claim 17, wherein the tapered midsection tapers in the proximal direction.

19. The down-the-hole drill hammer of claim 17, wherein the tapered midsection includes:

a first frustroconical section adjacent the supply inlet;

a first tubular section adjacent the first frustroconical section;

a second frustroconical section adjacent the first tubular section;

a second tubular section adjacent the second frustroconical section; and a third frustroconical section adjacent the second tubular section.

20. A down-the-hole drill hammer comprising:

a housing;

a backhead at a proximal end of the housing, the backhead including:

a supply inlet for receiving a supply of working fluid to an interior of the backhead, an exhaust port for communicating between the interior of the backhead and an exterior of the backhead, a tubular distal end, and a tapered midsection interior in communication with the supply inlet that includes:

a frustroconical section adjacent the supply inlet, and a tubular section adjacent the frustroconical section; and a tubular sliding check valve assembly within the housing proximate to the backhead, the sliding check valve assembly including:

a distributor having:

a central opening, an aperture extending through the distributor in an axial direction and offset from the central opening for allowing the passage of working fluid through the distributor, and an exhaust gallery for communicating between the central opening and the exhaust port, and a sliding valve slidable along the central opening and movable between a closed position and an open position, the sliding valve including:

a closed proximal end, an open distal end, and an opening about a midsection of the sliding valve, and a biasing member biasing the sliding valve to the closed position, wherein, in the closed position, the proximal end of the sliding valve sealingly engages the supply inlet and a distal end of the sliding valve sealingly engages an inlet opening of the exhaust gallery, and wherein, in the open position, the sliding valve is offset from the supply inlet, the openings of the sliding valve are in communication with the exhaust gallery, and the supply inlet is in communication with the aperture extending through the distributor.

21. A down-the-hole drill hammer comprising:

a housing;

a backhead at a proximal end of the housing, the backhead including a supply inlet for receiving a supply of working fluid to an interior of the backhead and an exhaust port for communicating between the interior of the backhead and an exterior of the backhead to exhaust working fluid to an exterior of the backhead at the proximal end of the housing;

a tubular sliding check valve assembly within the housing proximate to the backhead, the sliding check valve assembly including:

a distributor, and a sliding valve slidable along the distributor, a biasing member biasing the sliding valve to sealingly engage the closed proximal end to the supply inlet; and a piston reciprocally mounted within the housing.

22. The down-the-hole drill hammer of claim 21, wherein the housing has an internal diameter (ID), wherein the sliding valve includes an inwardly extending flange having a distally facing surface area about 2-4% of the $ID^2$, and wherein the biasing member has a restoring force in lbs. of about 90-125% of the numerical value of the $ID^2$.

23. The down-the-hole drill hammer of claim 21, further comprising a drive chamber positioned between the backhead and the piston, wherein the sliding valve includes a closed proximal end sealingly engaged with the supply inlet, and the piston sealingly engages a seal proximate a distal end of the housing.

24. A down-the-hole drill hammer comprising:

a housing;

a backhead at a proximal end of the housing, the backhead including a supply inlet for receiving a flow of supply pressure to an interior of the backhead;

a tubular sliding check valve assembly within the housing proximate to the backhead, the sliding check valve assembly including:

a distributor having a central through bore that extends axially and completely through the distributor, and a sliding valve slidable along the distributor, a biasing member biasing the sliding valve to sealingly engage the closed proximal end to the supply inlet;

a piston reciprocally mounted within the housing;

a seal proximate a distal end of the housing between the piston and the housing; and a drive chamber positioned between the backhead and the piston, wherein the sliding valve sealingly engages the supply inlet, and the piston sealingly engages the seal proximate the distal end of the housing to maintain an elevated pressure within the drive chamber upon the discontinuance of the flow of supply pressure.

25. The down-the-hole drill hammer of claim 24, wherein the drive chamber is maintained at a pressure of at least 35 p.s.i.

* * * * *